US010228173B2

(12) United States Patent
Broglia

(10) Patent No.: US 10,228,173 B2
(45) Date of Patent: Mar. 12, 2019

(54) COMPRESSOR FOR A REFRIGERATING PLANT AND REFRIGERATING PLANT COMPRISING SAID COMPRESSOR

(71) Applicant: FRASCOLD S.p.A., Rescaldina (IT)

(72) Inventor: Thomas Broglia, Rescaldina (IT)

(73) Assignee: FRASCOLD S.P.A. (IT)

( * ) Notice: Subject to any disclaimer, the term of this patent is extended or adjusted under 35 U.S.C. 154(b) by 285 days.

(21) Appl. No.: 14/783,490

(22) PCT Filed: Apr. 11, 2014

(86) PCT No.: PCT/IB2014/060655
§ 371 (c)(1),
(2) Date: Oct. 9, 2015

(87) PCT Pub. No.: WO2014/167542
PCT Pub. Date: Oct. 16, 2014

(65) Prior Publication Data

US 2016/0061503 A1 Mar. 3, 2016

(30) Foreign Application Priority Data

Apr. 11, 2013 (IT) ..... MI2013A0583

(51) Int. Cl.
*F25B 1/02* (2006.01)
*F25B 49/02* (2006.01)
(Continued)

(52) U.S. Cl.
CPC ..... *F25B 49/022* (2013.01); *F04B 49/22* (2013.01); *F04B 49/225* (2013.01); *F25B 1/02* (2013.01);
(Continued)

(58) Field of Classification Search
CPC ..... F25B 49/022; F25B 41/043; F25B 1/02; F25B 2400/074; F25B 2600/0272;
(Continued)

(56) References Cited

U.S. PATENT DOCUMENTS 2,766,593 A 10/1956 Orville et al.
3,168,108 A * 2/1965 Patrick ..... F16K 15/18 137/542
(Continued)

FOREIGN PATENT DOCUMENTS

EP 0297514 1/1989
EP 0628722 A1 * 12/1994 ..... F04B 27/1804
EP 1918587 5/2008

OTHER PUBLICATIONS

Corresponding International Search Report and Written Opinion for PCT/IB2014/060655 dated Aug. 12, 2014.

*Primary Examiner* — Orlando E Aviles
*Assistant Examiner* — Miguel A Diaz
(74) *Attorney, Agent, or Firm* — The Belles Group, P.C.

(57) ABSTRACT

A compressor for a refrigerating plant comprising at least one cylinder (12); at least one piston (13), which slides alternately inside the cylinder (12); at least one head (18*a*) provided with a suction chamber (19), connected to a suction line (9) of the plant (1) and to the cylinder (12) to supply the cylinder (12) with a refrigerating fluid, and with a suction valve (25*a*), configured to regulate the flow rate of refrigerating fluid; the suction valve (25*a*) is movable between a first position, wherein is defined a first flow area which allows the suction of a first flow rate of refrigerating fluid, and a second position wherein is defined a second flow area smaller than the first flow area which allows the suction of a second flow rate of refrigerating fluid lower than the first flow rate.

20 Claims, 5 Drawing Sheets

(51) Int. Cl.
*F25B 49/00* (2006.01)
*F04B 49/22* (2006.01)
*F25B 41/04* (2006.01)
*F04B 39/06* (2006.01)

(52) U.S. Cl.
CPC ..... *F25B 41/043* (2013.01); *F04B 39/06* (2013.01); *F25B 2400/074* (2013.01); *F25B 2600/0272* (2013.01)

(58) Field of Classification Search
CPC .... F25B 41/065; F25B 1/10; F25B 2400/076; F25B 2700/1933; F01L 2760/003; F01L 13/00; F01L 13/06; F01L 1/00; F01L 15/04; F01L 15/00; F01B 3/0055; F01B 3/0058; F01B 3/0061; F04B 49/22; F04B 49/225; F04B 49/065; F04B 39/06; F04B 27/1804; F04B 2027/1822; F04B 2027/1831; F04B 2027/1859; F04B 2027/1881; F04B 2027/1818; F04B 2207/041; F04B 39/123; F04B 53/1025; F04C 28/10; F04C 28/12; F04C 28/14
See application file for complete search history.

(56) References Cited

U.S. PATENT DOCUMENTS 3,335,738 A 8/1967 Frederik et al.
3,449,923 A * 6/1969 Kivioja ..... F25B 41/00 137/503
3,698,204 A 10/1972 Schlotterbeck et al.
4,905,477 A * 3/1990 Kazuhiko ..... F04B 27/1804 417/311
5,191,768 A * 3/1993 Fujii ..... B60H 1/3207 62/176.6
6,092,993 A * 7/2000 Young ..... F04B 39/0005 417/221
6,138,468 A * 10/2000 Yokomachi ..... F04B 27/1804 236/91 C
6,227,812 B1 * 5/2001 Kawaguchi ..... F04B 27/1804 417/222.2
6,250,093 B1 * 6/2001 Fujii ..... B60H 1/3223 62/159
6,257,848 B1 * 7/2001 Terauchi ..... F04B 49/225 417/307
6,276,154 B1 8/2001 Pippin
6,293,117 B1 * 9/2001 Ban ..... B60H 1/3225 62/228.3
6,389,824 B2 * 5/2002 Ota ..... F04B 27/1804 417/222.2
6,401,472 B2 * 6/2002 Pollrich ..... F04B 27/0414 417/213
6,520,751 B2 * 2/2003 Fujita ..... F04B 27/1804 137/513.3
7,861,541 B2 * 1/2011 Dieckmann ..... F01C 1/0246 62/116
7,931,452 B2 * 4/2011 Hibino ..... F04B 27/1018 137/493.9
8,720,213 B2 * 5/2014 Cochran ..... F04B 49/225 62/217
9,022,061 B2 * 5/2015 Kim ..... F04B 27/1804 137/468
9,513,040 B2 * 12/2016 Wakisaka ..... F16K 1/36
9,651,037 B2 * 5/2017 Sakakibara ..... F04B 27/1804
2001/0026762 A1 * 10/2001 Fujita ..... F04B 27/1804 417/295
2005/0244279 A1 * 11/2005 Murakami ..... F04B 27/1036 417/222.2
2006/0165535 A1 * 7/2006 Ota ..... F04B 27/1804 417/222.2
2006/0218959 A1 * 10/2006 Sandkoetter ..... F04B 49/225 62/324.1
2008/0104984 A1 * 5/2008 Kanai ..... F04B 27/1804 62/228.3
2008/0107543 A1 * 5/2008 Ota ..... F04B 49/225 417/253
2009/0214356 A1 * 8/2009 Barrett, II ..... F04B 49/022 417/12
2010/0095690 A1 * 4/2010 Bush ..... F04B 5/00 62/115
2012/0107159 A1 * 5/2012 Lifson ..... F04B 1/0452 417/440
2013/0098086 A1 * 4/2013 Sillato ..... F25B 49/02 62/184
2013/0230415 A1 * 9/2013 Dallai ..... F04B 39/08 417/228
2013/0276920 A1 * 10/2013 Sakakibara ..... F04B 49/22 137/544
2014/0056727 A1 * 2/2014 Koyama ..... F04C 18/0215 417/228
2014/0283546 A1 * 9/2014 Wakisaka ..... F16K 1/36 62/528
2015/0044080 A1 * 2/2015 Spiegl ..... F04B 49/03 417/505
2016/0061503 A1 * 3/2016 Broglia ..... F25B 41/043 62/228.5

* cited by examiner

COMPRESSOR FOR A REFRIGERATING PLANT AND REFRIGERATING PLANT COMPRISING SAID COMPRESSOR

PRIORITY

Priority is claimed as a national stage application, under 35 U.S.C. § 371, to international patent application No. PCT/IB2014/060655, filed Apr. 11, 2014, which claims priority to Italian patent application MI2013A000583, filed Apr. 11, 2013. The disclosures of the aforementioned priority applications are incorporated herein by reference in their entirety.

TECHNICAL FIELD

The present invention relates to a compressor for a refrigerating plant and a refrigerating plant comprising said compressor.

BACKGROUND ART

In the field of refrigerating plants there has always been a need for regulating the refrigerating capacity of the compressor based on the actual thermal load required. In fact, it often occurs that the refrigerating capacity of the compressor is excessive compared to the required thermal load. Such situation occurs, for example, in supermarket refrigerating plants or refrigerating rooms during night hours. The thermal load required overnight is, in fact, definitely lower than the thermal load required during daily hours, wherein operations of massive removal of food from refrigerating rooms, opening of freezer doors in a crowded place, etc. occur.

If the refrigerating capacity of the compressor is constant, during night hours the compressor is capable of bringing the environment to the desired temperature in a shorter time than the times required during daily hours.

Such situation may determine the occurrence various shortcomings, which contribute to compromising the efficiency of the entire refrigerating plant.

For example, the excessive refrigeration may lead to the formation of ice on the evaporator and determine a lowering of the dew point of the evaporator.

The lowering of the dew point may cause an excessive dehumidification of the processed air, creating uncomfortable conditions if the compressor supplies an air-conditioning system, or may cause a significant weight drop of the product stored if the compressor supplies a refrigerating room.

Some known solutions provide for the switching off of the compressor upon reaching the desired temperature and the restart of the compressor when the temperature exceeds a predetermined threshold value. Such solution, however, risks to dangerously increase the number of start-ups per hour of the compressor and significantly reduce the operating life of the compressor.

Another known solution provides for a plurality of low-power compressors instead of a single high-power compressor. However, such solution, besides having a high starting cost and a more complicated control system, does not overcome the disadvantage of having to frequently restart the compressors to face the thermal load variation.

A further known solution provides for the complete closing of the suction channel of the refrigerating fluid of at least one of the pistons of the plurality of compressor pistons when a reduction of thermal load occurs. In particular, such solution provides the use of a solenoid valve, which closes the suction channel when the evaporation temperature and pressure decrease below a respective threshold value. In this way, the "pumping" effect of at least one of the plurality of compressor pistons is cancelled and the flow rate of the compressed refrigerating fluid is reduced, reducing the refrigerating capacity of the compressor. Such solution, however, allows to reduce the input flow rate by 50% at the utmost when the supply channel of one piston out of two is closed. This type of regulation is too rough and is not sufficient to optimize the performance and efficiency of the plant upon variation of the required thermal load.

In order to obviate this drawback, a control system of the solenoid valve is used which is configured to time the opening of the solenoid valve in order to obtain a desired reduction of the flow rate of refrigerating fluid input to the piston. A control system of this type is described in the document US 2006/0218959. However, such solution proved to be not very efficient in that it determines a continuous fluctuation of pressures and temperatures inside the compressor, subjecting the inner parts of the compressor to dangerous stresses. Therefore, such solution is not reliable and requires constant monitoring of the operating conditions of the compressor.

DISCLOSURE OF INVENTION

It is therefore an object of the present invention to manufacture a compressor which is free from the prior art drawbacks mentioned above; in particular, it is an object of the present finding to manufacture a compressor reliable over time and the relative refrigerating capacity may be adjusted based on the thermal load in a simple and cheap way, but from the functional viewpoint and the construction viewpoint.

According to such objects, the present invention relates to a compressor for a refrigerating plant according to claim 1.

It is a further object of the finding to manufacture a refrigerating plant capable of adapting its own refrigerating capacity to the actual thermal load required.

According to such objects, the present invention relates to a refrigerating plant according to claim 16.

BRIEF DESCRIPTION OF THE DRAWINGS

Further features and advantages of the present invention will appear clearly from the following description of a non-limiting embodiment example thereof, made with reference to the figures in the accompanying drawings, in which.

BEST MODE FOR CARRYING OUT THE INVENTION

Figure 1:
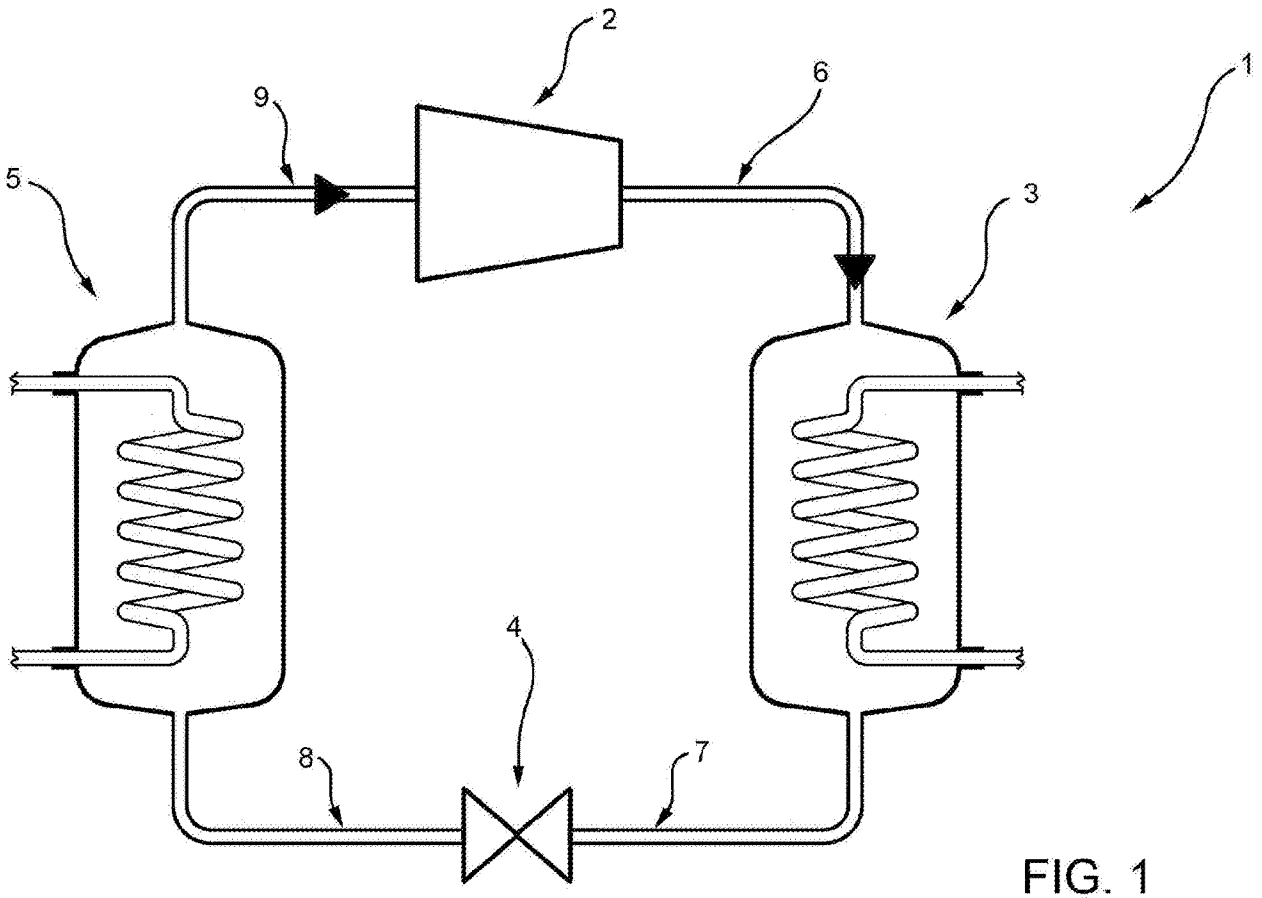
FIG. 1 shows a schematic view of a refrigerating plant according to the present invention.

In FIG. 1, reference numeral 1 indicates a refrigerating plant wherein a refrigerating fluid flows.

Refrigerating fluid means a refrigerating substance which may take the liquid or gaseous state inside the plant 1 depending on the pressure and temperature conditions to which it is subjected.

The refrigerating fluid is, for example, a fluid selected from the group consisting of HCFC, HFC, HFO, CO2, HC.

The plant 1 comprises a compressor 2, a condenser 3, an expansion valve 4 and an evaporator 5.

A high-pressure delivery line 6 supplies the condenser 3 with the refrigerating fluid compressed by the compressor 2. In particular, the refrigerating fluid supplied to the condenser 3 is in the form of vapour.

In the condenser 3 the refrigerating fluid in the form of vapour is transformed to the liquid form.

A high-pressure line 7 supplies the refrigerating fluid output from the condenser 3 to the expansion valve 4, where the pressure of the refrigerating fluid is lowered in order to lower the evaporation temperature.

A low-pressure line 8 supplies the low-pressure refrigerating fluid output from the expansion valve 4 to the evaporator 5, where heat is removed so that the refrigerating fluid evaporates at a constant pressure.

A low-pressure suction line 9 supplies the refrigerating fluid in the form of vapour and at low pressure to the compressor 2.

Figure 2:
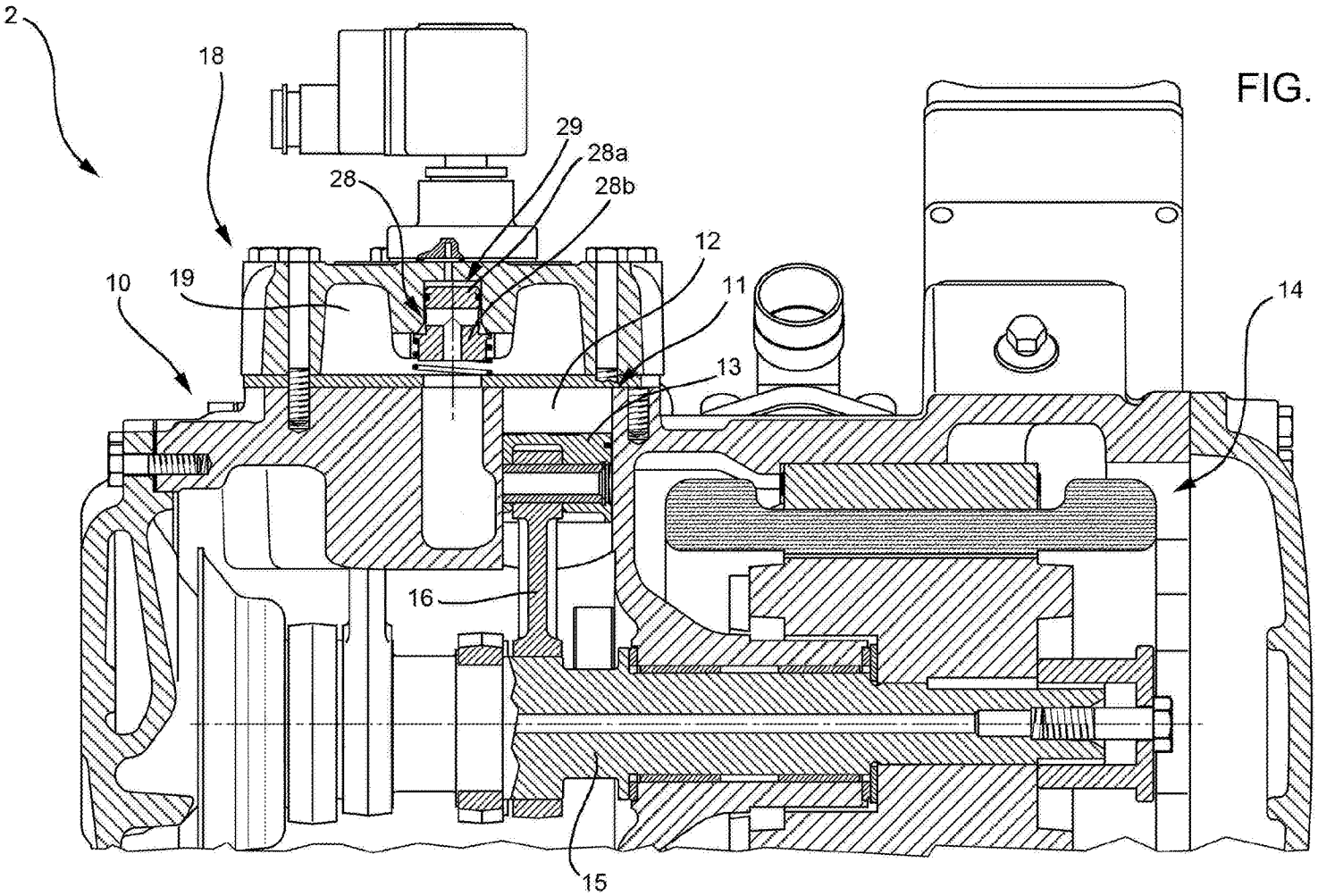
FIG. 2 shows a side view, with sectional parts and parts removed for clarity, of a compressor for a refrigerating plant according to the present invention.

With reference to FIG. 2, the compressor 2 is an alternative semi-hermetic refrigerating compressor.

Figure 3:
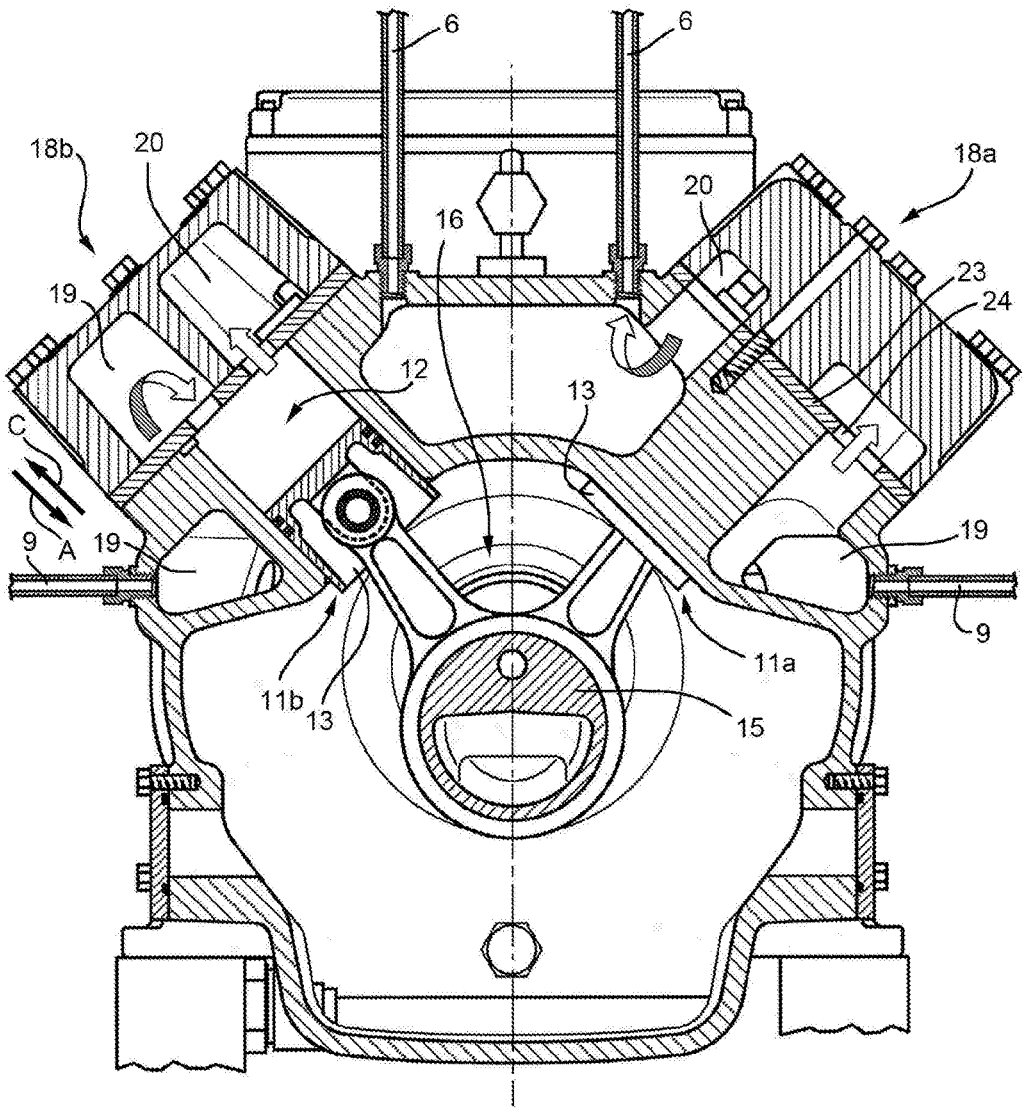
FIG. 3 shows a front view, with sectional parts and parts removed for clarity, of the compressor of FIG. 2.

In the non-limiting example described and illustrated herein, the compressor 2 comprises a main body 10 inside which there are obtained two cylinder banks 11 having a substantially V-shape arrangement with each another (better shown in FIG. 3).

Each cylinder bank 11 comprises one or more cylinders 12.

In the example of the compressor described and illustrated herein each cylinder bank 11 comprises two cylinders 12.

Inside each cylinder 12, a respective piston 13 moves alternately thanks to an electric motor 14.

In particular, each piston 13 is connected to a crankshaft 15 of the electric motor 14 by means of a rod-crank mechanism 16 (partially visible in the appended figures) and moves alternately in a suction direction A (FIG. 3) and in a compression direction C (FIG. 3). In the suction direction A, the piston 13 draws the refrigerating fluid, while in the compression direction C, the piston 13 compresses the refrigerating fluid.

Each cylinder bank 11 is coupled to a respective head 18 which puts the cylinders 12 in communication with the suction line 9 and the delivery line 6 of the plant 1.

With particular reference to FIG. 3, a first cylinder bank 11*a* is coupled to a first head 18*a*, while a second cylinder bank 11*b* is coupled to a second head 18*b*.

Each head 18*a*, 18*b* comprises a low-pressure suction chamber 19 and a high-pressure delivery chamber 20.

The suction chamber 19 is in communication with the suction line 9 of the plant 1 and with the cylinders 12 and is passed through by the refrigerating fluid during the stroke of the pistons 13 in the suction direction A.

The delivery chamber 20 is in communication with the delivery line 6 of the plant 1 and with the cylinders 12 and is passed through by the refrigerating fluid during the stroke of the pistons 13 in the compression direction C.

In particular, the suction chamber 19 is preferably divided into two portion by a partition 23 provided with an opening 24 through which the refrigerating fluid flows.

Figures 4, 5, 10:
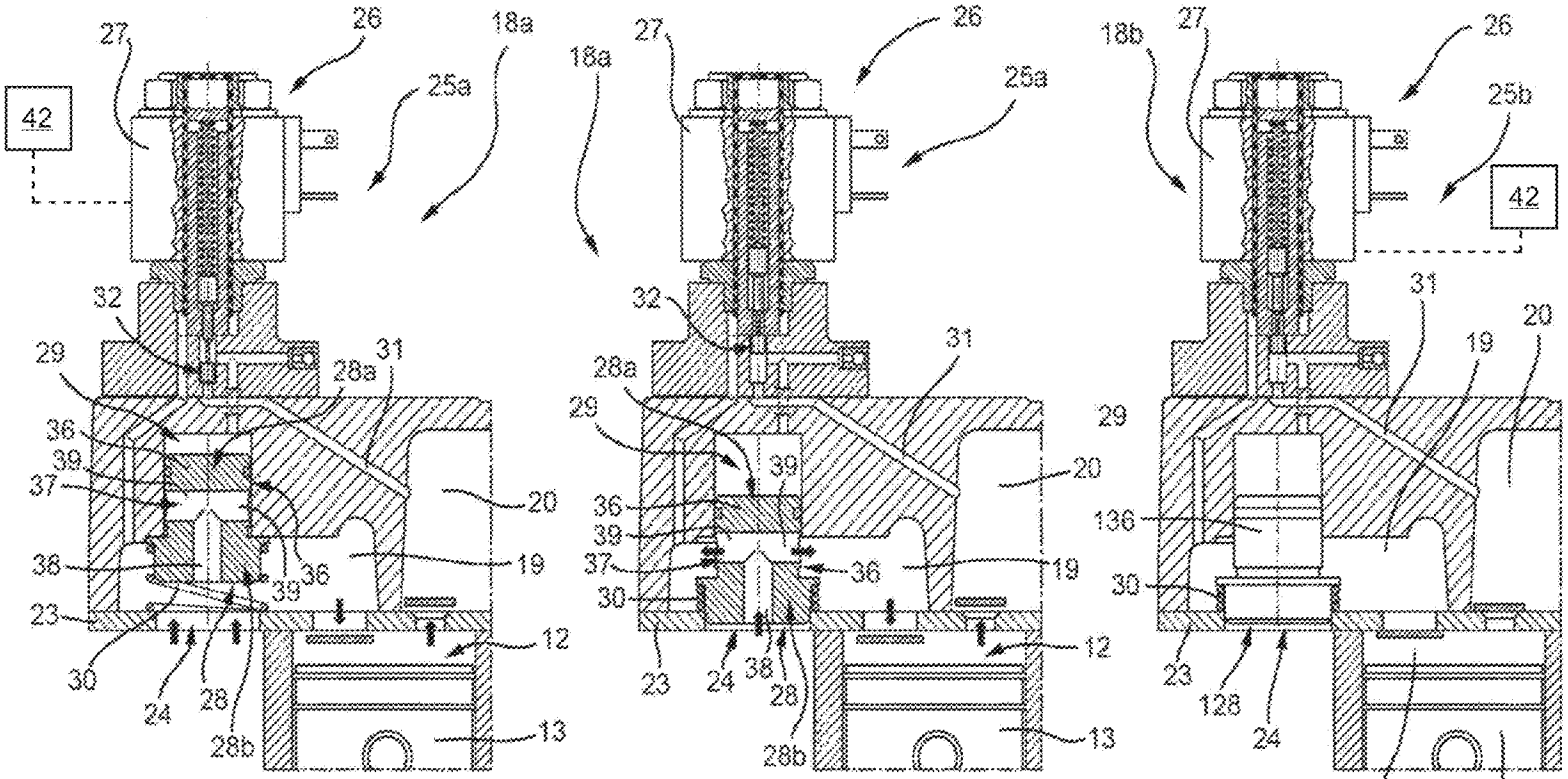
FIG. 4 is a sectional view, with parts removed for clarity, of a first detail of the compressor of FIG. 2 in a first operating position.
FIG. 5 is a sectional view, with parts removed for clarity, of a first detail of the compressor of FIG. 2 in a second operating position.
FIG. 10 is a sectional view, with parts removed for clarity, of a second detail of the compressor for a refrigerating plant of FIG. 2.

With reference to FIG. 2 and FIG. 4, the head 18*a* further comprises a suction valve 25*a*, which is arranged so as to regulate the flowing of the refrigerating fluid drawn through the opening 24.

With reference to FIG. 10, the head 18*b* further comprises a suction valve 25*b*, which is arranged so as to regulate the flowing of the refrigerating fluid drawn through the opening 24.

FIG. 4 shows the head 18*a* provided with the suction valve 25*a*.

The suction valve 25*a* is movable between a first position, wherein the opening 24 is free and the regular flowing of the refrigerating fluid between the suction line 9 and the cylinders 12 is allowed, and a second position wherein the flow of refrigerating fluid between the suction line 9 and the cylinders 12 is reduced.

Preferably, in the first position the suction valve defines a first flow area of the refrigerating fluid coinciding with the flow area of the opening 24. The first flow area allows the flowing of a first flow rate of refrigerating fluid.

In the second position, the suction valve 25*a* defines a second flow area of the refrigerating fluid, which allows the flowing of a second flow rate of refrigerating fluid lower than the first flow rate.

In particular, the first flow area and the second flow area are shaped so as to allow, in the second position, the flowing of a second flow rate comprised between 10% and 90% of the first flow rate.

Preferably, in the second position there is a reduction of the flow rate of refrigerating fluid greater than or equal to 50%, with respect to the first position. It is understood that in the second position the suction valve 25*a*, in any case, allows the flowing of a flow rate of refrigerating fluid, which is minimum and greater than zero.

The first position and the second position are end positions of the suction valve 25*a*.

In the non-limiting example described and illustrated herein, the suction valve 25*a* comprises a solenoid valve 26 provided with a coil 27, a shutter 28 movable in a seat 29, and a return spring 30 secured to the partition 23 and arranged around the shutter 28.

The seat 29 is in communication with the high-pressure delivery chamber 20 by means of a communication channel 31. In particular, the seat 29 is obtained in a wall of the suction chamber 19 and is arranged so as to be coaxial to the opening 24.

The solenoid valve 26 is provided with a closing member 32, which is coupled to a iron core 33 arranged inside the inner channel 34 of the coil 27 and a spring 35, arranged in the inner channel 34 in abutment against the iron core 33. The closing member 32 is arranged so as to selectively occlude the communication channel 31.

In use, when the coil 27 is not powered with current, the spring 35 keeps the closing member 32 in the closing position of the communication channel 31.

When the coil 27 is powered with current, the iron core 33 is attracted to the coil 27 up to overcoming the force of the spring 35 and determines a displacement of the closing member 32 sufficient to free the communication channel 31.

When the communication channel 31 is free, the seat 29 is filled with the high-pressure refrigerating fluid of the delivery chamber 20. The pressure of the refrigerating fluid overcomes the combined action of the return spring 30 and the suction pressure and pushes the shutter 28 towards the opening 24.

The shutter 28 comprises a main body 36 having a flow area substantially coinciding with the flow area of the opening 24 so as to completely engage the opening 24 in the second position of the valve 25*a*.

In particular, the shutter 28 comprises a main portion 28*a* slidable inside the seat 29 and a head portion 28*b*, which has a radial dimension greater than the radial dimension of the main portion 28*a*. The head portion 28*b* is arranged in abutment against the wall of the suction chamber 19 wherein is obtained the seat 29 in the first position and it engages the opening 24 in the second position.

The main body 36 is provided with a channel 37 suitably shaped so as to allow the flowing of a determined flow rate of refrigerating fluid even when the shutter 28 engages the opening 24.

Preferably, the channel 37 is obtained inside the shutter and is substantially T-shaped. In particular, the channel 37 comprises an inlet 38 facing the portion of the suction chamber 19 communicating with the low-pressure suction line 9 and two outlets 39, each facing a respective portion of the suction chamber 19 in the proximity of the respective cylinders 12 to be supplied.

Preferably, the main portion 28*a* comprises the outlets 39 while the head portion 28*b* comprises the inlet 38.

In the non-limiting example described and illustrated herein, when the suction valve 25*a* is in the second position (configuration of FIG. 5) and the shutter 28 engages the opening 24, the channel 37 defines such a flow area that it allows the flowing of a flow rate equal to 50% of the first flow rate which normally flows through the opening 24 (configuration of FIG. 4 with the valve in the first position). In the practice, when the suction valve 25*a* is in the second position, the flow rate of refrigerating fluid is reduced by 50%.

The reduction of the flow rate of refrigerating fluid supplied to the cylinders 12 determines a reduction of the refrigerating capacity of the compressor 2.

The power supply to the coil 27 is preferably regulated by a control system 42 suitably configured to power the coil 27 when a reduction of the refrigerating capacity of the compressor 2 is required. As will be seen in detail hereinafter, the reduction of the refrigerating capacity of the compressor 2 is necessary when there is a reduction of the required thermal load.

Required thermal load herein and hereinafter means the refrigerating capacity to be supplied, or the heat to dissipate (expressed in kW), needed to keep a determined temperature in the refrigerating room or in the environment to air-condition.

Figure 6:
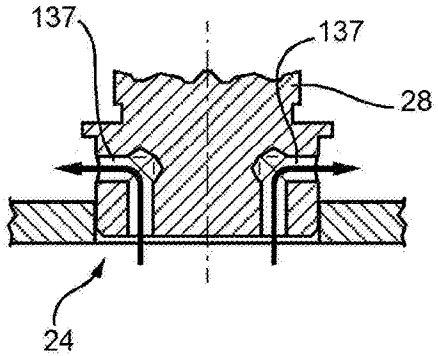
FIG. 6 is a sectional view of a detail of a compressor for a refrigerating plant according to a second embodiment.

FIG. 6 shows a first variant of the present invention wherein the shutter 28 is provided with a plurality of channels 137 suitably shaped so as to define a flow area that allows the flowing of a determined second flow rate of refrigerating fluid.

Figure 7:
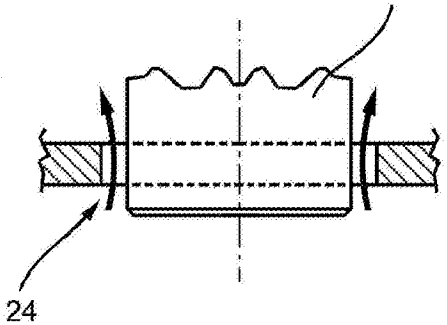
FIG. 7 is a sectional view of a detail of a compressor for a refrigerating plant according to a third embodiment.

FIG. 7 shows a second variant, which envisages that the shutter 28 is shaped so that it does not entirely engage the opening 24 in the second position so as to define a flow area through which the flowing of a determined flow rate of refrigerating fluid is allowed. Preferably, the flow rate of refrigerating fluid which flows through the flow area when the shutter 28 partially engages the opening 24 will be comprised between 10% and 50% of the flow rate which regularly flows through the free opening 24.

In the example of FIG. 7, the shutter 28 has a flow area smaller than the flow area of the opening 24 to define such a flow area that it allows the passage of a determined flow rate of refrigerating fluid lower than the flow rate which regularly flows through the free opening 24.

Figure 8:
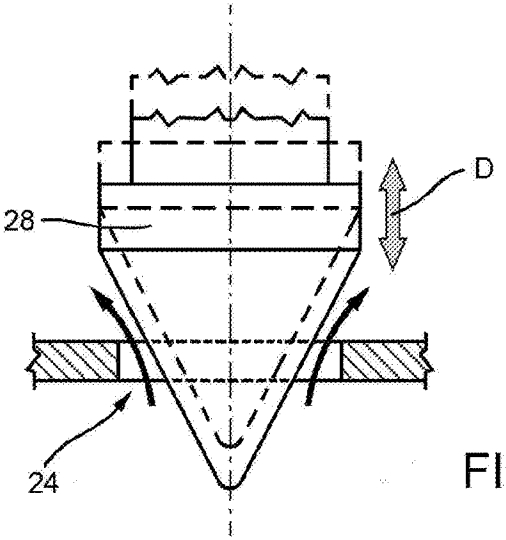
FIG. 8 is a sectional view of a detail of a compressor for a refrigerating plant according to a fourth embodiment.

FIG. 8 shows a third variant wherein the shutter 28 has a substantially truncated-cone shape. In this case, the controlled movement of the shutter 28 along a direction D allows to regulate the flow area defined by the shutter 28 and the opening 24. This embodiment of the shutter 28 allows a variable regulation of the flow rate of refrigerating fluid drawn. The closer the shutter 28 to the opening 24, the lower the amount of refrigerating fluid which passes through the opening 24.

A variant not shown envisages that the shutter has a pyramid or tapered shape.

Figure 9:
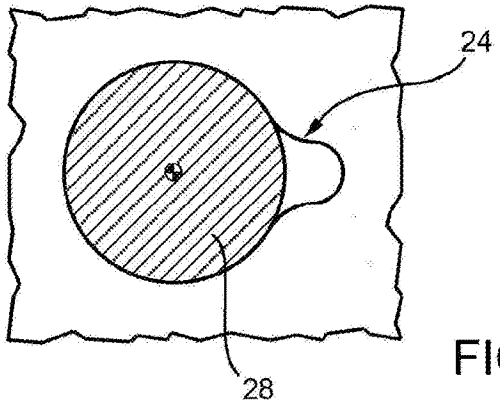
FIG. 9 is a sectional view of a detail of compressor for a refrigerating plant according to a fifth embodiment.

A further embodiment illustrated in FIG. 9 envisages that the opening 24 is shaped so as to define a flow area for the refrigerating fluid even when the shutter 28 engages the opening 24. For example, the opening 24 is defined by two lobes and the shutter 28 is shaped so as to engage only one of the two lobes of the opening 24.

With reference to FIG. 10, the suction valve 25*b* is arranged in the head 18*b* and is configured so as to regulate the flowing of the refrigerating fluid drawn through the opening 24.

The suction valve 25*b* is movable between a third position, wherein the opening 24 is free and the regular flowing of the refrigerating fluid between the suction line 9 and the cylinders 12 is allowed, and a fourth position wherein the flow of refrigerating fluid between the suction line 9 and the cylinders 12 is stopped. In the third position, the suction valve 25*b* defines a third flow area of the refrigerating fluid, coinciding with the opening 24.

When the suction valve 25*b* is in the fourth position, there is a 100% reduction of the flow rate of refrigerating fluid.

In the non-limiting example described and illustrated herein, the suction valve 25*b* is substantially the same as the valve 25*a* with the exception that it comprises a shutter 128, which is configured so as to completely close the opening 24 when the valve 25*b* is in the fourth position.

The shutter 128 comprises a main body 136 having a flow area substantially coinciding with the flow area of the opening 24 so as to completely engage the opening 24 in the fourth position of the valve 25*a* and to occlude the flowing of the refrigerating fluid.

The main body 136 of the shutter 128 is full and is not provided with channels or openings capable of allowing the flowing of refrigerating fluid even when the shutter 128 engages the opening 24.

The power supply of the coil 27 of the suction valve 25*b* is preferably regulated by the control system 42.

Similarly to what described above for the suction valve 25*a*, the control system 42 is configured to power the coil 27 when a reduction of the thermal load of the compressor 2 is needed.

In particular, the control system 42 is configured to selectively activate the coil 27 of the suction valve 25*a* and the coil 27 of the suction valve 25*b* so as to regulate the refrigerating capacity of the compressor based on the required thermal load.

In particular, the control system 42 may selectively activate/deactivate the coils 27 of the suction valves 25*a*, 25*b* so as to substantially obtain four different configurations:

- a nominal configuration wherein the suction valve 25*a* and the suction valve 25*b* are in the first and the third position, respectively, allowing the regular flowing of 100% of the refrigerating fluid drawn;
- a configuration at 75% wherein the suction valve 25*b* is in the third position and the coil 27 of the suction valve 25*a* is activated so that the suction valve 25*a* is in the second position and the shutter 28 engages the opening 24. In such configuration in the head 18*a*, there is a flow of refrigerating fluid of 25% of the total amount supplied by the compressor, while in the head 18*b* the suction valve 25*b* is in the third position and the flow of refrigerating fluid is regular and equal to 50% of the total amount supplied by the compressor. Accordingly, the flow of refrigerating fluid which reaches the cylinders 12 is equal to 75% of the flow of refrigerating fluid supplied in the nominal configuration;
- a configuration at 50% wherein the suction valve 27*b* is in the first position and the coil 27 of the suction valve 25*b* is activated so that the suction valve 25*b* is in the fourth position and the shutter 128 engages the opening 24. In such configuration, in the head 18*a* there is a regular flow of refrigerating fluid, while in the head 18*b* the opening 24 is closed and the flow of refrigerating fluid is null. Accordingly, the flow of refrigerating fluid which reaches the cylinders 12 is equal to 50% of the flow of refrigerating fluid supplied in the nominal configuration (only the refrigerating fluid drawn by the head 18*a* is supplied);
- a configuration at 25% wherein the suction valve 25*a* and 25*b* are in the second and in the fourth position, respectively; in such configuration the shutter 28 in the head 18*a* allows the flowing of a flow of refrigerating fluid equal to about 25% of the regular flow, while the shutter 128 does not allow the flowing of refrigerating, fluid in the head 18*b*.

It is understood that the configurations at 75% and 25% are exemplary and depend on the flow area defined by the suction valve 25*a* in the second position.

For example, the suction valve 25*a* is configured so as to define such a flow area that it allows a flow equal to 20% of the regular flow when it is in the second position, the configurations that may be obtained by means of the regulation carried out by the control system 42 will be as follows: nominal configuration, configuration at 70%, configuration at 50% and configuration at 20%.

Advantageously, in the compressor according to the present invention it is possible to regulate the refrigerating capacity based on the required variations of thermal load in a simple and effective way.

In particular, the presence of at least one suction valve that allows the flowing of a minimum flow rate of refrigerating fluid also in the second position allows to obtain greater flexibility in terms of regulation of the refrigerating capacity based on the thermal load. Moreover, the construction of the suction valve 25*b* is very simple and does not subject the compressor to pressure stresses or excessive vibrations which in the long term may jeopardize the reliability of the compressor itself.

Advantageously, the compressor according to the present invention may be used in refrigerating plants that use any type of refrigerating fluid.

Finally, it is clear that changes and variations may be made to the compressor and plant described herein without departing from the scope of the appended claims.

The invention claimed is:

1. A compressor for a refrigerating plant comprising:

at least one cylinder;

at least one piston, which slides alternately inside the cylinder;

at least one head provided with a suction chamber, connected to a suction line of the plant and to the cylinder to supply the cylinder with a refrigerating fluid, and with a suction valve, configured to regulate the refrigerating fluid flow rate;

the suction valve being movable between a first position wherein a first flow area is defined which allows the suction of a first flow rate of refrigerating fluid from the suction line to the at least one cylinder, and a second position wherein a second flow area that is smaller than the first flow area is defined which allows the suction of a second flow rate of refrigerating fluid lower than the first flow rate from the suction line to the at least one cylinder;

wherein the suction chamber is divided into two portions by a partition provided with an opening through which the refrigerating fluid flows; and wherein the suction valve comprises a shutter, a portion of the shutter being positioned in the opening of the partition in the second position and no portion of the shutter being positioned in the opening of the partition in the first position, the shutter and the opening of the partition being shaped so as to define the first flow area in the first position and the second flow area in the second position.

2. The compressor according to claim 1, wherein the first flow area and the second flow area are shaped so that the second flow rate is between 10% and 90% of the first flow rate.

3. The compressor according to claim 1, wherein the first flow area and the second flow area are shaped so that the second flow rate is equal to 50% of the first flow rate.

4. The compressor according to claim 1, wherein the first position and the second position are end positions of the suction valve.

5. The compressor according to claim 1, wherein the shutter is shaped so as to define the second flow area to allow the flowing of the second flow rate of refrigerating fluid through the shutter.

6. The compressor according to claim 1, wherein the shutter is provided with at least one channel shaped so as to define the second flow area.

7. The compressor according to claim 1, wherein in the first position an entirety of the shutter is located in one of the two portions of the suction chamber.

8. The compressor according to claim 1, wherein the shutter is provided with a plurality of channels shaped so as to totally define the second flow area.

9. The compressor according to claim 1, wherein the shutter has a cross section smaller than a cross section of the opening of the partition so as to define the second flow area and allow the flowing of the second flow rate in the second position.

10. The compressor according to claim 1, wherein the shutter is substantially truncated cone shaped and is configured so as to define the second flow area in the second position to allow the flowing of the second flow rate.

11. The compressor according to claim 1, comprising a control system configured to control the position of the suction valve on the basis of the required thermal load.

12. The compressor according to claim 1, wherein the first and second flow areas are defined within the opening of the partition.

13. A refrigerating plant comprising at least one suction line and at least one compressor as claimed in claim 1.

14. The compressor according to claim 1 wherein the partition has a first surface facing a first portion of the suction chamber and an opposite second surface facing a second portion of the suction chamber, the opening extending in an axial direction from the first surface of the partition to the second surface of the partition, and wherein the shutter is configured to move in the axial direction between the first and second positions.

15. The compressor according to claim 1 further comprising a return spring secured to the partition and coupled to the shutter.

16. The compressor according to claim 1 wherein the shutter comprises a first end, a second end, and a body extending therebetween along an axis, and wherein the portion of the shutter that is positioned within the opening of the partition in the second position includes the second end of the shutter.

17. The compressor according to claim 1, comprising:

at least a further cylinder; at least a further piston, which slides alternately inside the further cylinder; a further head provided with a further suction chamber, connected to the suction line of the plant and to the further cylinder to supply the further cylinder with a refrigerating fluid, and with a further suction valve, configured to regulate the refrigerating fluid flow rate;

the further suction valve being movable between a third position, wherein is defined a third flow area which allows the suction of a third flow rate of refrigerating fluid from the suction line to the further cylinder, and a fourth position wherein the third flow area is occluded and flow of the refrigerating fluid from the suction line to the further cylinder is stopped.

18. The compressor according to claim 17, wherein the further suction valve comprises a further shutter configured to engage a further opening of the further suction chamber in the fourth position; the further shutter and the further opening being shaped so as to occlude the third flow area in the fourth position.

19. The compressor according to claim 18 wherein in the fourth position the further shutter completely blocks the further opening to prevent flow of the refrigerant fluid through the further opening.

20. The compressor according to claim 17 wherein the compressor is configured to operate in one of:

a first configuration wherein the suction valve is in the first position and the further suction valve is in the third position, thereby allowing flow of the refrigerating fluid at a normal flow rate;

a second configuration wherein the suction valve is in the second position and the further suction valve is in the third position;

a third configuration wherein the suction valve is in the first position and the further suction valve is in the fourth position, thereby allowing flow of the refrigerating fluid at a flow rate that is 50% of the normal flow rate; and a fourth configuration wherein the suction valve is in the second position and the further suction valve is in the fourth position;

wherein in the second configuration the refrigerating fluid flows at a flow rate that is greater than 50% and less than 100% of the normal flow rate; and wherein in the fourth configuration the refrigerating fluid flows at a flow rate that is less than 50% and greater than 0% of the normal flow rate.

* * * * *